United States Patent [19]

Higashio et al.

[11] Patent Number: 5,008,714

[45] Date of Patent: Apr. 16, 1991

[54] IMAGE FORMING APPARATUS HAVING AN AUTOMATIC DOCUMENT FEED DEVICE FOR AUTOMATICALLY DISCHARGING A MANUALLY POSITIONED DOCUMENT

[75] Inventors: Kimihiko Higashio; Yoichi Kawabuchi, both of Osaka, Japan

[73] Assignee: Minolta Camera Kabushiki Kaisha, Osaka, Japan

[21] Appl. No.: 254,726

[22] Filed: Oct. 7, 1988

[30] Foreign Application Priority Data

Oct. 9, 1987 [JP] Japan ..... 62-255918

[51] Int. Cl.[5] ..... G03G 21/00

[52] U.S. Cl. ..... 355/313; 355/309

[58] Field of Search ..... 355/75, 230, 233, 234, 355/308, 309, 313

[56] References Cited

U.S. PATENT DOCUMENTS

| | | | |
|---|---|---|---|
| 4,099,860 | 7/1978 | Connin | 355/309 X |
| 4,235,550 | 11/1980 | Case | 355/230 X |
| 4,264,188 | 4/1981 | Tomosada et al. | 355/309 X |
| 4,281,919 | 8/1981 | Nomura et al. | 355/309 X |
| 4,685,797 | 8/1987 | Ito | 355/313 |
| 4,743,945 | 5/1988 | Ito et al. | 355/244 |
| 4,879,574 | 11/1989 | Nakamura et al. | 355/309 X |

FOREIGN PATENT DOCUMENTS

| | | |
|---|---|---|
| 61-238042 | 10/1986 | Japan . |
| 1430856 | 4/1976 | United Kingdom . |

*Primary Examiner*—Fred L. Braun

*Attorney, Agent, or Firm*—Burns, Doane, Swecker & Mathis

[57] ABSTRACT

An image duplicating apparatus having an automatic document feed device. The document feed device is movable between an opened and a closed position, and is operable to automatically convey documents to a document support table of an image forming device, and to automatically discharge documents from the document support table after images from the documents have been copied by the image forming device. An automatic document discharge prohibit instruction is produced by a control arrangement of the apparatus when a document is manually placed on the document support table, however a document discharge instruction may be manually entered to override the prohibit instruction, if desired by an operator of the apparatus.

4 Claims, 13 Drawing Sheets

A04

B01
SDP = 1
NO
YES
B02
INDICATOR 128a ON
NO
YES
B03
TURN OFF INDICATOR 128a
B04
TURN ON INDICATOR 128a
B05
SPS = 1
NO
YES
B06
SD1 = 1
NO
YES
B07
SLP = 1
NO
YES
B08
SADF ← 1
B09
SDUP ← 1
RETURN

IMAGE FORMING APPARATUS HAVING AN AUTOMATIC DOCUMENT FEED DEVICE FOR AUTOMATICALLY DISCHARGING A MANUALLY POSITIONED DOCUMENT

FIELD OF THE INVENTION

The present invention relates to an image duplicating apparatus particularly of the type including an automatic document feed module.

BACKGROUND OF THE INVENTION

An image duplicating apparatus of the type having an automatic document feed module in addition to an ordinary image duplicator module is known and is in wide use. The automatic document feed module has a document support tray for storing a set of original document sheets to be duplicated and is operative to automatically convey the original document sheets successively to a prescribed position on a transparent document support table of the image duplicator module. The original document sheet conveyed to the prescribed position on the document support table during each cycle of operation of the apparatus is optically scanned and the image duplicator module produces a printed output or a desired number of printed outputs on the basis of the information produced by the scanning operation. After scanning, the original document sheet is automatically withdrawn from the automatic document feed module module so that the feeding module is ready for the subsequent cycle of operation.

There are various natures of materials desired to be duplicated in such an image duplicating apparatus. These materials will include those which could not be handled by an automatic document feed module of an ordinary design. Typical of the materials which an automatic document feed module could not handle are books and other bound volumes of sheet materials and those sheet materials which are so thin that an ordinary automatic document feed module could not move on the document support table of the image duplicator module. When it is desired to duplicate images on such a thin sheet material or a page or pages of a bound volume of sheet materials, the operator is required to place the original on the document support table of the image duplicator module without the aid of the automatic document feed module. To allow the operator direct access to the document support table, the automatic document feed module is hingedly assembled to the image duplicator module and can thus be "opened" up from the document support table of the image duplicator module.

After the material manually placed on the document support table of the image duplicator module is scanned, the material is removed from the document support table also manually by the operator. Intervention of the automatic document feed module in removing the material from the document table is prohibited with a view to precluding any damage that might be caused to the material if the material manually placed on the document support table is to be removed automatically by the automatic document feed module.

Whereas, an automatic document feed module is capable of conveying an original document material to a predetermined position on the document support table of an image duplicator module. The position to which the original document material is to be conveyed is determined automatically by the automatic document feed module per se and could not be altered or adjusted at the operator's option. When the operator desires to have an original document material conveyed to his desired position on the document support table, the operator is required to place the document material manually without the aid of the automatic document feed module. Since the intervention of the automatic document feed module in withdrawing an original document material from the document support table is prohibited, the operator is also required to manually remove the document material from the document support table even if the material is of a nature that can be handled by the automatic document feed module. It will however be convenient if an original document material which has once been manually placed on the document support table of the image duplicator module can be withdrawn automatically by means of the automatic document feed module if the document material is of a nature that can be handled by the automatic document feed module.

Accordingly, it is an important object of the present invention to provide an improved image duplicating apparatus equipped with an automatic document feed module capable of automatically withdrawing an original document sheet from the document support table of the image duplicator module at the operator's option even if the material may have been placed on the document support table without the aid of the automatic document feed module.

SUMMARY OF THE INVENTION

The present invention contemplates elimination of such problems inherent in known image duplicating apparatus of the described types.

In accordance with one outstanding aspect of the present invention, there is provided an image duplicating apparatus comprising (a) a transparent document support table, (b) an image forming device for copying images on an original document sheet placed on the document support table, (c) an original document feeding device for conveying an original document sheet to a predetermined position on the document support table and discharging the original document sheet from the predetermined position, the original document feeding device being angularly movable in its entirety with respect to the image forming device and having an angular position allowing manual access to the document support table, (d) first input means for entering an instruction to start copying operation, (e) first control means responsive to the instruction for controlling the image forming device and the original document feeding device so that the image forming device and the original document feeding device operate in conjunction with each other for automatically conveying an original document sheet to the predetermined position on the document support table and discharging the original document sheet from the predetermined position after the copying operation for the particular original document sheet is terminated, the first control means being operative to enable the image forming device to start copying operation without the intervention of the original document feeding device when the first control means responds to the instruction after an original document sheet has been manually placed on the document support table with the original forming device held in the angular position, the first control means being further operative to produce an automatic document discharge prohibit instruction to prohibit automatic discharge of the manually placed original document sheet from the document support table after the copying operation for the particular original document sheet is terminated, (f) second input means allowing manual entry of a document discharge instruction for automatically discharging an original document sheet from the document support table, and (g) second control means responsive to the document discharge instruction for invalidating the automatic document discharge prohibit instruction.

In accordance with another outstanding aspect of the present invention, there is provided an image duplicating apparatus comprising (a) a transparent document support table, (b) an image forming device for copying images on an original document sheet placed on the document support table, (c) an original document feeding device for conveying an original document sheet to a predetermined position on the document support table and discharging the original document sheet from the predetermined position, the original document feeding device being angularly movable in its entirety with respect to the image forming device and having an open angular position allowing manual access to the document support table, (d) first input means for entering an instruction to start copying operation, (e) first control means responsive to the instruction for controlling the image forming device and the original document feeding device so that the image forming device and the original document feeding device operate in conjunction with each other for automatically conveying an original document sheet to the predetermined position on the document support table and discharging the original document sheet from the predetermined position after the copying operation for the particular original document sheet is terminated, the first control means being operative to enable the image forming device to start copying operation without the intervention of the original document feeding device when the first control means responds to the instruction after an original document sheet has been manually placed on the document support table with the original forming device held in the open angular position, the first control means being further operative to produce an automatic document discharge prohibit instruction to prohibit automatic discharge of the manually placed original document sheet from the document support table after the copying operation for the particular original document sheet is terminated, (f) second input means allowing manual entry of a document discharge instruction for automatically discharging an original document sheet from the document support table, and (g) second control means responsive to the document discharge instruction for activating the original document feeding device to automatically discharge an original document sheet from the document support table whether the original document sheet may have been placed on the document support table manually or by means of the original document feeding device.

In accordance with still another outstanding aspect of the present invention, there is provided an image duplicating apparatus comprising (a) a transparent document support table, (b) an image forming device for copying images on an original document sheet placed on the document support table, (c) an original document feeding device for conveying an original document sheet to a predetermined position on the document support table and discharging the original document sheet from the predetermined position, the original document feeding device being angularly movable in its entirety with respect to the image forming device and having an angular position allowing manual access to the document support table, (d) manual input means allowing manual entry of a document discharge instruction for automatically discharging an original document sheet from the document support table, (e) a control device responsive to the document discharge instruction for activating the original document feeding device to automatically discharge an original document sheet from the document support table whether the original document sheet may have been placed on the document support table manually or by means of the original document feeding device.

In accordance with still another outstanding aspect of the present invention, there is provided an image duplicating apparatus comprising (a) an image forming device including a transparent document support table and operative to copy images on an original document sheet placed on the document support table, (b) an original document feeding device having open and closed positions with respect to the document support table and operative to convey an original document sheet to a predetermined position on the document support table and discharge the original document sheet from the predetermined position after the images on the original document sheet have been copied by the image forming device, the original document feeding device in the open position allowing manual placement of an original document sheet on the document support table, (c) a first input device allowing manual entry of a copying start instruction to start copying operation, (d) a second input device allowing manual entry of a document discharge instruction for automatically discharging an original document sheet from the document support table, and (e) a control device responsive to the copying start instruction for controlling the image forming device and the original document feeding device so that the image forming device and the original document feeding device operate in conjunction with each other for automatically conveying an original document sheet to the predetermined position on the document support table and discharging the original document sheet from the predetermined position after the copying operation for the particular original document sheet is terminated, the control device being operative to control each of the original document feeding device and the image forming device to enable the image forming device to start copying operation without activating the original document feeding device when the control device responds to the copying start instruction after an original document sheet has been manually placed on the document support table with the original forming device held in the open position, the control device being responsive to the document discharge instruction for activating the original document feeding device to discharge the manually placed original document sheet from the document support table.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

Figure 1:
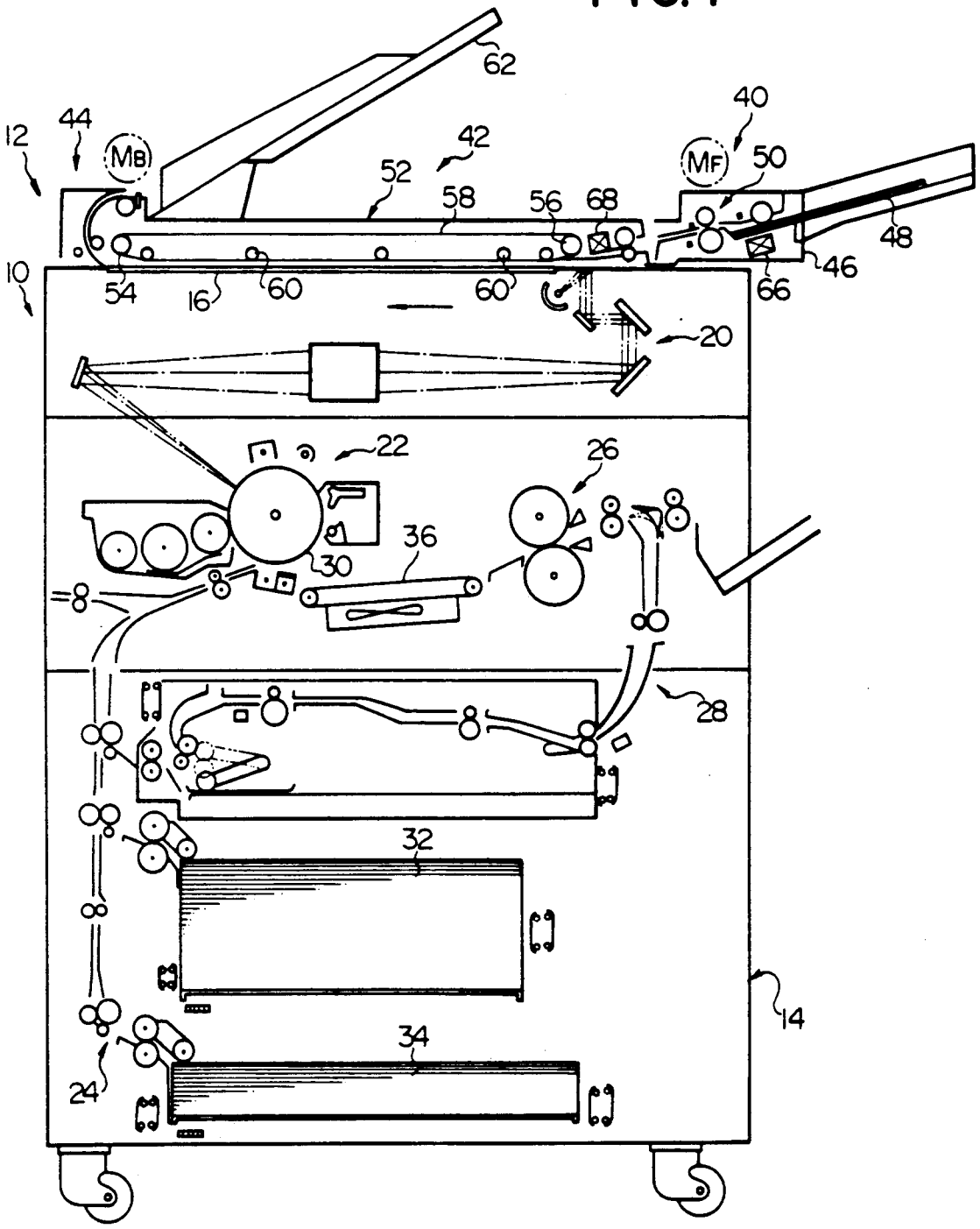
FIG. 1 is an elevation view showing the general mechanical construction and arrangement of a preferred embodiment of an image duplicating apparatus according to the present invention.

A preferred embodiment of an image duplicating apparatus according to the present invention will be hereinafter described with reference to the drawings, first particularly to FIG. 1 which shows the general mechanical construction and arrangement of such an embodiment. As shown in FIG. 1, the image duplicating apparatus embodying the present invention largely consists of a main module implemented by an electrophotographic duplicator module 10, and an optional or subsidiary module implemented by an automatic document feeding module 12 positioned atop the duplicator module 10.

The duplicator module 10 has a housing structure 14 including an upper panel portion which is in part provided by a transparent document support table 16. A sheet of original document bearing images to be reproduced is to be placed on this document support table 16, though not shown in the drawings.

The duplicator module 10 further comprises an optical scanning system 20, an image reproducing system 22, a print sheet feed system 24, an image fixing system 26, a print sheet recirculation system 28. The optical scanning system 20 is operative to optically scan the original document sheet placed on the document support table and produce a beam of light carrying information representative of the images detected from the document sheet. The information-carrying light is directed to an image transfer drum 30 forming part of the image reproducing system 22 and produces electrostatic latent images on the photoconductive peripheral surface of the drum 30. The electrostatic latent images thus produced on the photoconductive peripheral surface of the image transfer drum 30 are converted into visible toner images, which are then transferred to a print sheet supplied from one of print sheet storage trays 32 and 34 by means of the print sheet feed system 24. The print sheet thus carrying the visible toner images is conveyed by a sheet transport belt assembly 36 to the image fixing system 26 by means of which the toner images on the print sheet are thermally fixed on the surface of the print sheet.

Past the image fixing system 26, the print sheet having images printed on one of its surfaces is withdrawn from the image duplicator module 10 or is fed back to the print sheet feed system 24 by means of the print sheet recirculation system 28. The print sheet fed back to the print sheet feed system 24 by means of the print sheet recirculation system 28 is for a second time passed over to the image reproducing system 22 so that images are to be printed in a duplex mode or in a composite mode on the print sheet.

The construction of the image duplicator module 10 herein shown and briefly described above is well known in the art as from, for example, U.S. Pat. No. 4,743,945 which may be referenced for further details of the module 10.

On the other hand, the automatic document feeding module 12 implementing the subsidiary module of the apparatus embodying the present invention largely comprises a document supply assembly 40 to place an original document sheet on the document support table 16, a document transport assembly 42 to convey the original document sheet to a predetermined position on the document support table 16, and a document discharge assembly 44. These assemblies 40, 42 and 44 are arranged in series in a horizontal direction in which an original document sheet is to be conveyed through the automatic document feed module 12.

The document supply assembly 40 comprises a housing 46 having inlet and outlet slots, a document supply tray 48 extending into the housing 46 through the inlet slot, and a pair of document feed rollers 50 located at the leading end of top of the document supply tray 48. The document feed rollers 50 are driven for rotation by means of a roller drive motor $M_F$ positioned within the housing 46. An original document sheet sheet (not shown) to be copied is placed on the document supply tray 48 through the inlet slot of the housing 46 and is passed into the document transport assembly 42 through the outlet slot of the housing 46.

The document transport assembly 42 comprises a lid structure 52 and is arranged to be rockable in its entirety away from and toward the document support table 16 about an axis extending lengthwise of the transport assembly 42. The lid structure 52 has carried thereon a conveyor mechanism including belt drive rollers 54 and 56 spaced apart in parallel from each other and positioned in the vicinity of the front and rear ends, respectively, of the document transport assembly 42. An endless transport belt 58 is passed between these rollers 54 and 56 and has a lower travelling path portion which extends in parallel with the document support table 16 and which is to travel in the direction of advancement of original document sheet. Between the belt drive rollers 54 and 56 are arranged guide and pressing rollers 60 which are held in rollable contact with the inner surface of the lower travelling path portion of the belt 58 to press the particular portion of the belt 58 into slidable contact with the upper face of the document support table 16. One of the belt drive rollers such as the roller 54 is driven for rotation by means of a belt drive motor $M_B$. An original document sheet supplied from the document supply assembly 40 to the document transport assembly 42 is moved by the transport belt 58 to a correct "exposure position" on the document support table 16 and is scanned by the optical scanning system 20 of the duplicator module 10. After the original document sheet set on the document support table 16 is thus scanned by the optical scanning system 20, the original document sheet is either withdrawn to a document recovery tray 62 forming part of the lid structure 52 and a subsequent original document sheet on the document supply tray 48 is transferred to the document support table 16. This operation is repeatedly performed until all the original document sheets stored on the document supply tray 48 have been duplicated. The driven roller 54 is operatively connected to the belt drive motor 54 through suitable actuator means such as a solenoid-operated clutch.

Figure 2:
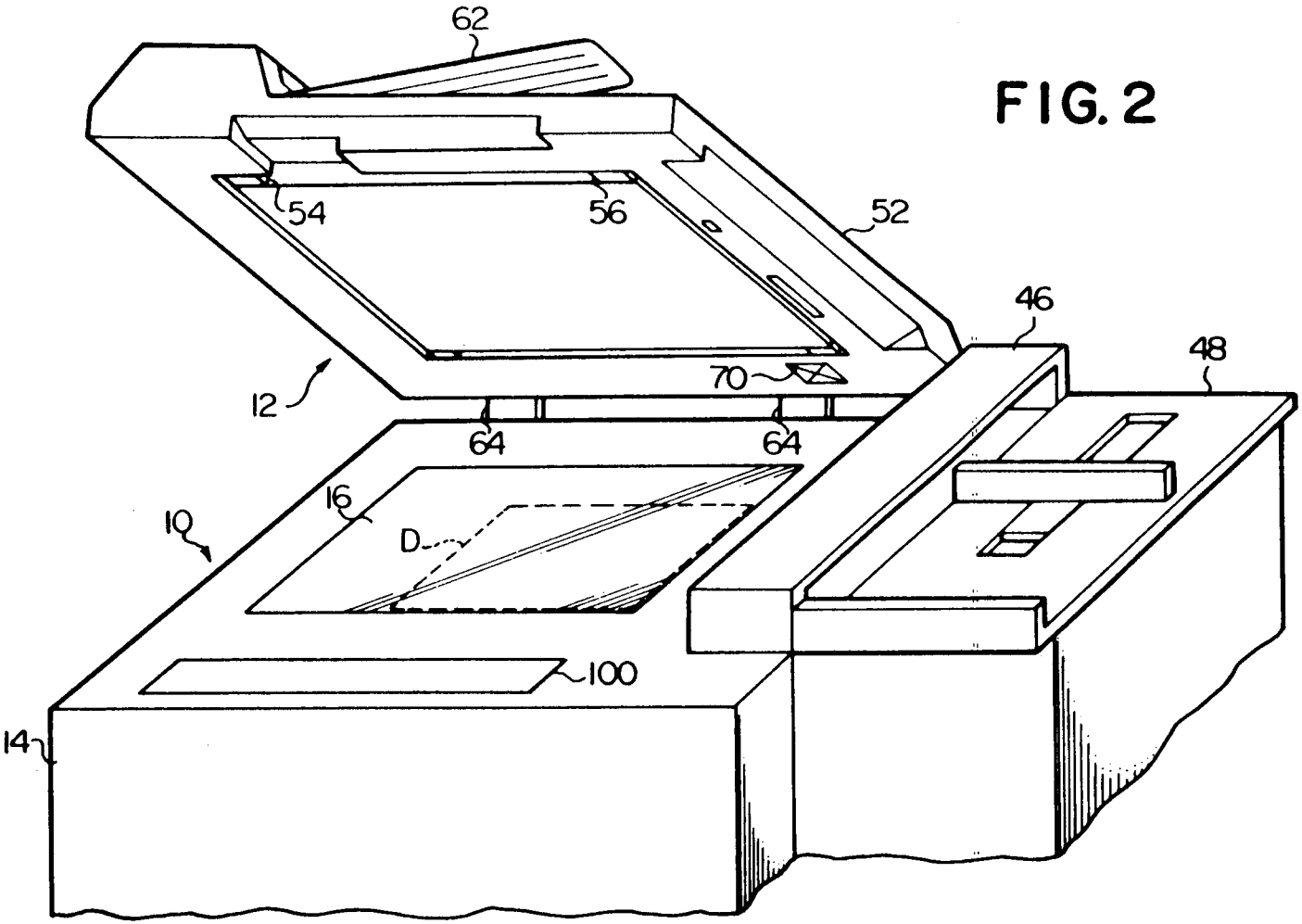
FIG. 2 is fragmentary perspective view showing the general construction of the automatic document feed module which forms part of the image duplicating apparatus embodying the present invention.

The lid structure 52 forming part of the document transport assembly 42 is hingedly assembled to the housing structure 14 by means of hinge elements 64 as shown in FIG. 2. The document transport assembly 42 as a whole is thus rockable between a "closed" angular position having the lower travelling path portion of the belt 58 held in slidable contact with the document support table 16 as shown in FIG. 1 and an "open" angular position angularly spaced apart upwardly from the document support table 16 as shown in FIG. 2. The lid structure 52 of the document transport assembly 42 being thus opened up from the document support table 16 of the image duplicator module 10, the operator is allowed for direct access to the document support table 16 to manually place an original document sheet on the upper face of the document support table 16 as indicated by broken lines in FIG. 2.

The image duplicating apparatus embodying the present invention further comprises various sensors and detectors arranged within the main and subsidiary modules 10 and 12. The sensors and detectors provided in association with the automatic document feed module 12 include a document-on-tray sensor 66 located in conjunction with the document supply tray 48 of the document supply assembly 40. The document-on-tray sensor 66 is responsive to the presence or absence of at least one original document sheet on the document supply tray 48 and is operative to produce an output signal $S_{D1}$ of a logic "1" state in the presence of an original document sheet on the tray 48. On the other hand, the document transport assembly 42 has provided therein a document-on-table sensor 68. The document-on-table sensor 68 is located adjacent the inlet of the document transport assembly 42 and is responsive to the presence or absence of at least one original document sheet on the document support table 16 of the image duplicator module 10 and is operative to produce an output signal $S_{D2}$ of a logic "1" state in the presence of an original document sheet on the document support table 16. In the vicinity of one of the hinge elements 64 is provided a lid position sensor 70 which is responsive to movement of the lid structure 52 between the open and closed angular positions thereof with respect to the image duplicator module 10. The lid position sensor 70 is operative to produce an output signal $S_{LP}$ of a logic "1" state when the lid structure 52 is held in the closed angular position on the document support table 16 of the image duplicator module 10.

Figure 3:
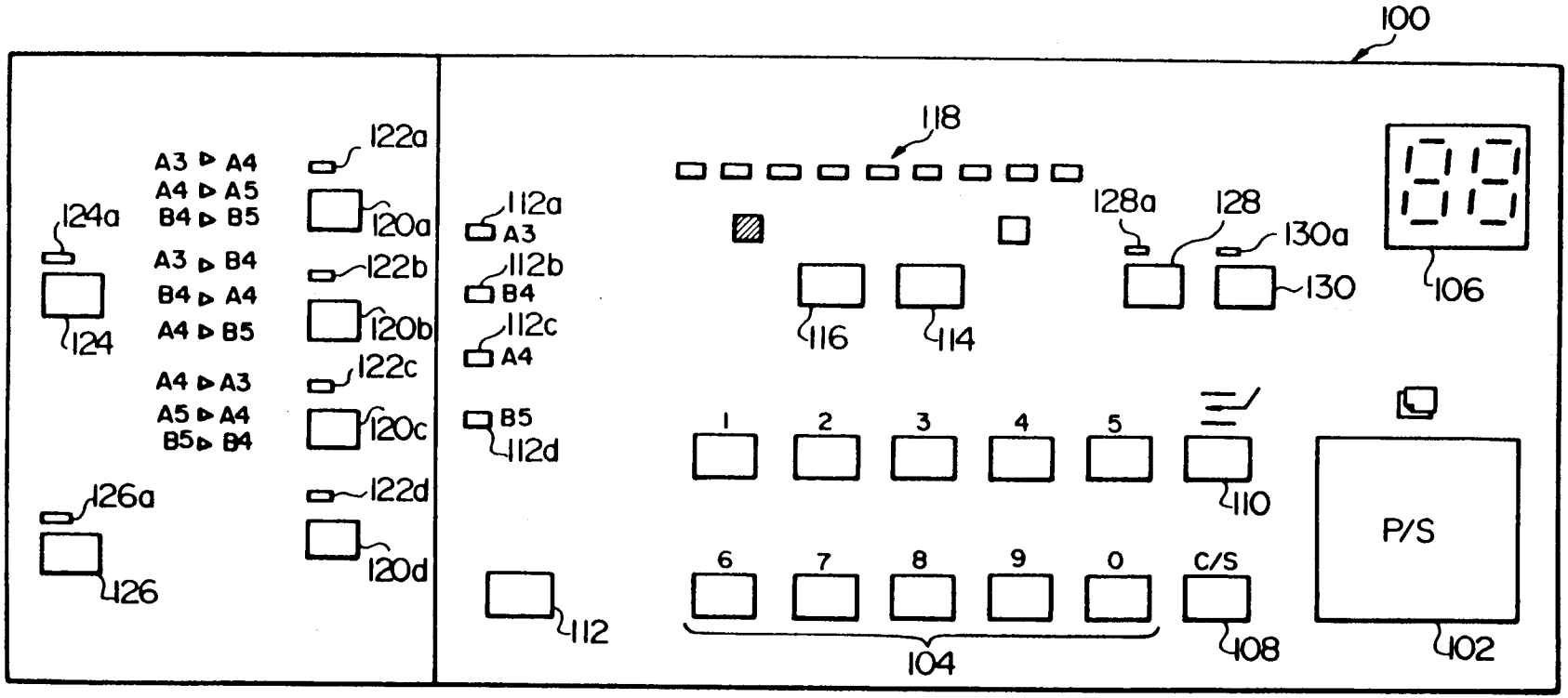
FIG. 3 is a plan view schematically showing the general configuration of the control panel of the image duplicator module which also forms part of the image duplicating apparatus embodying the present invention.

The various functions achievable by the image duplicating apparatus embodying the present invention will be understood from the following description regarding the general configuration of a control panel 100 forming part of the image duplicating apparatus. FIG. 3 shows the general configuration of the control panel 100.

Referring to FIG. 3, the control panel 100 comprises a print start key 102 (P/S) to start a cycle or cycles of duplicating operation and a set of numerical keys 104 allocated to numerals 1, 2, . . . and 0, respectively. With the print start key 102 depressed, there is a print-start signal $S_{PS}$ of a logic "1" state produced in the control panel 100 to indicate that the system is required to operate for copying operation for a given original document sheet. The numerical keys 104 are typically used to enter a desired number of printed outputs. The desired number of printed output thus entered from the numerical keys 104 is displayed on a seven-segment display window 106 and can be cleared from a clear/stop key 108 (C/S) which may be used also for cancelling the instruction once entered from the print start key 102. During printing of a preset quantity of print sheets for a given original document sheet, another original document sheet may be duplicated in an interrupt mode entered at an interrupt request key 110.

The size of print sheets to be used can be selected at a manual print sheet size select key 112 from among a predetermined number of document sizes available. The selected size of print sheet is displayed by any of print sheet size indicators 112*a*, 112*b*, 112*c* and 112*d* which are herein assumed to be assigned to the standardized A3, B4, A4 and B5 sizes, respectively, as shown. Further provided are print density increment and decrement keys 114 and 116 to permit manual selection of a desired density for printing. The print density is stepwise incremented with the key 114 depressed or decremented with the key 116 depressed. A series of print density display indicators 118 are activated to illuminate successively in one direction with the increment key 114 kept depressed and in the other direction with the decrement key 116 kept depressed.

On the control panel 100 are further provided a set of magnification ratio select keys 120*a*, 120*b*, 120*c* and 120*d* having respectively associated indicators 122*a*, 122*b*, 122*c* 122*d*. The keys 120*a* to 120*d* are assumed to be used for the selection of any of first and second ratios for reduced copying, a ratio for magnified copying and a ratio for equal-size copying. With one of the keys 120*a* to 120*d* depressed, the associated one of the indicators 122*a* to 122*d* is activated to illuminate to indicate the selected ratio for copying. Further provided on the control panel 100 is a duplex mode select key 124 for selecting the duplex mode of copying operation and a composite mode select key 126 for selecting the composite mode of copying operation. These duplex and composite mode select keys 124 and 126 have associated indicators 124*a* and 126*a* each of which is to be activated to illuminate when the associated one of the keys 124 and 126 is depressed to select the duplex or composite mode of copying operation.

In the control panel 100 of the image duplicating apparatus embodying the present invention, there are further provided a document discharge prohibit key 128 having an associated indicator 128a and a document discharge request key 130 having an associated indicator 130a. The document discharge prohibit key 128 is used to prohibit automatic withdrawal of an original document sheet from the automatic document feed module 12 and a signal $S_{DP}$ of a logic "1" state is produced and concurrently and the associated indicator 128a is activated to illuminate when the key 128 is depressed. The document discharge request key 130 is used to request automatic withdrawal of an original document sheet from the automatic document feed module 12 and a signal $S_{DR}$ of a logic "1" state is produced and concurrently the associated indicator 130a is activated to illuminate when the key 130 is depressed.

Assume now that the print start key 102 is depressed with the lid structure 52 closed to the document support table 16 of the image duplicator module 10 and an original document sheet placed on the document supply tray 48. The image duplicator module 10 is now ready for operation and, in the automatic document feed module 12, the roller drive motor $M_F$ and belt drive motor $M_B$ are actuated to drive the document feed rollers 50 and belt drive rollers 54 and 56, respectively. The document feed rollers 50 of the document supply assembly 40 being driven for rotation, the original document sheet sheet placed on the document supply tray 48 is passed into the document transport assembly 42 through the outlet slot of the housing 46. The original document sheet thus supplied from the document supply assembly 40 to the document transport assembly 42 is moved by the transport belt 58 on the document support table 16 and is brought to a stop in a predetermined period of time after the leading end of the document sheet is detected by the document-on-table sensor 68. At the point of time the leading end of the document sheet is detected by the sensor 68, an instruction signal is supplied from the automatic document feed module 12 to the image duplicator module 10 to initiate the image duplicator module 10 into operation for producing a desired number of printed duplicates of the original document sheet on the document support table 16. When the cycles of printing operation have been repeated the desired number of times, an instruction signal is supplied now from the image duplicator module 10 to the automatic document feed module 12 to enable the automatic document feed module 12 to withdraw the original document sheet to the document recovery tray 62. If it is then detected by the document-on-tray sensor 66 that there is another original document sheet placed on the document supply tray 48, the original document sheet is transferred to the document support table 16 while the preceding original document sheet is being withdrawn from the automatic document feed module 12.

When, on the other hand, the print start switch 102 is depressed with the lid structure 52 held open from the document support table 16 of the image duplicator module 10 or in the absence of an original document sheet on the document supply tray 48, the image duplicator module 10 is initiated into operation with the automatic document feed module 12 held at rest. The original document sheet which may have been manually placed on the document support table 16 is not withdrawn by the automatic document feed module 12 unless the document discharge request key 130 is depressed after the operation by the image duplicator module 10 is terminated.

Figure 4A:
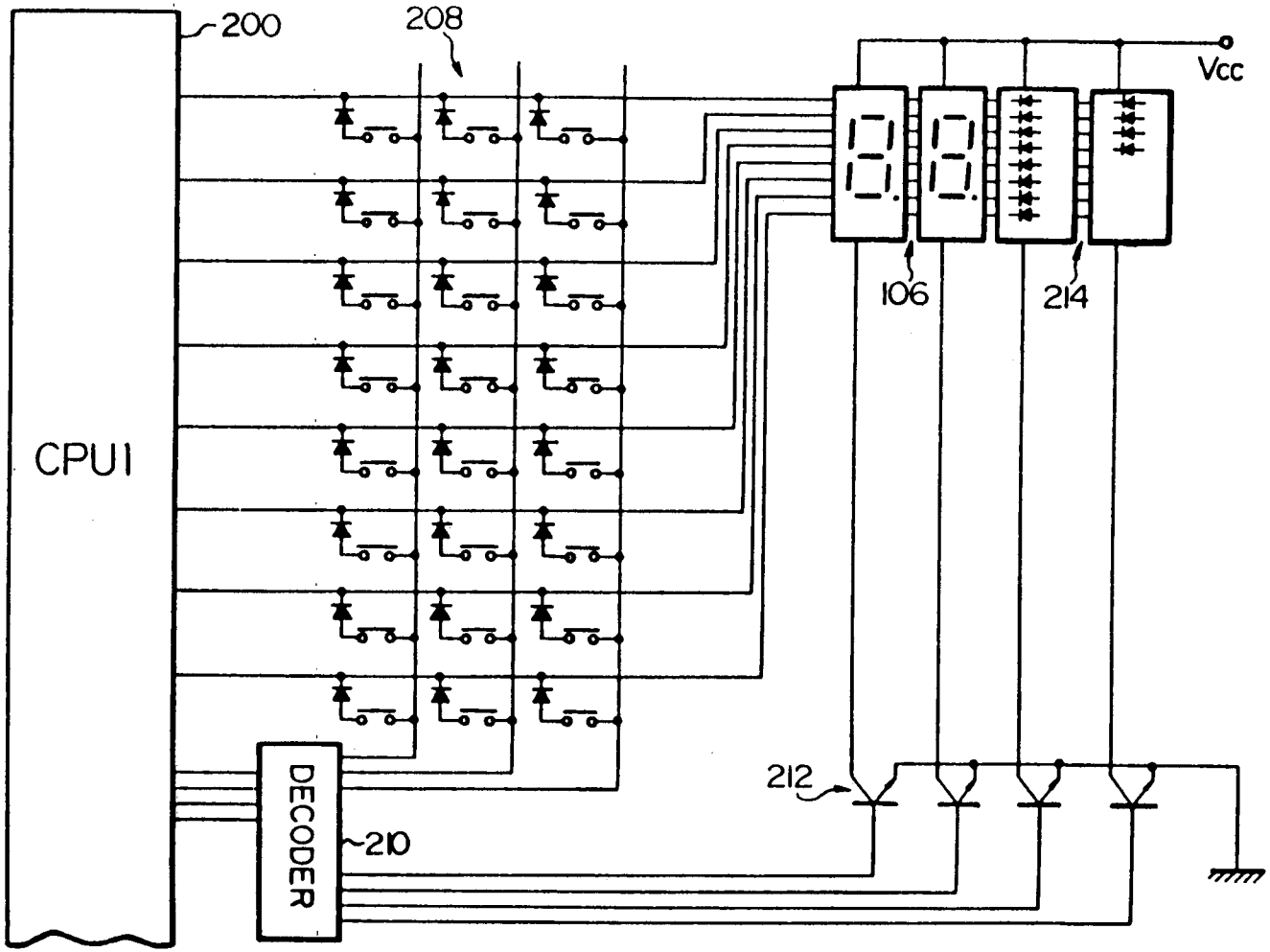
FIGS. 4A to 4C are complementary block diagrams schematically showing the general arrangement of a control circuit which may be incorporated in the image duplicating apparatus embodying the present invention.
Figure 4B:
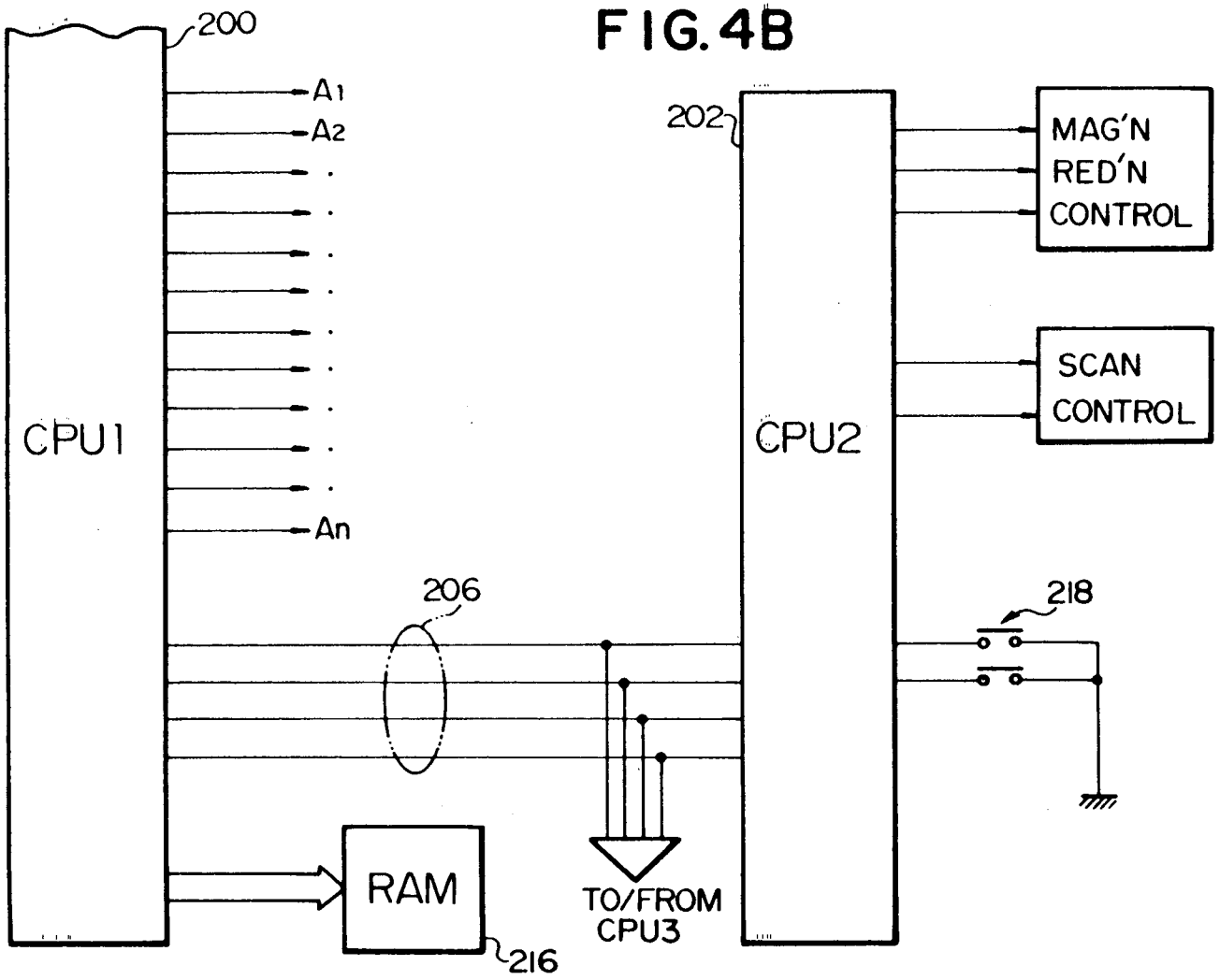
Figure 4C:
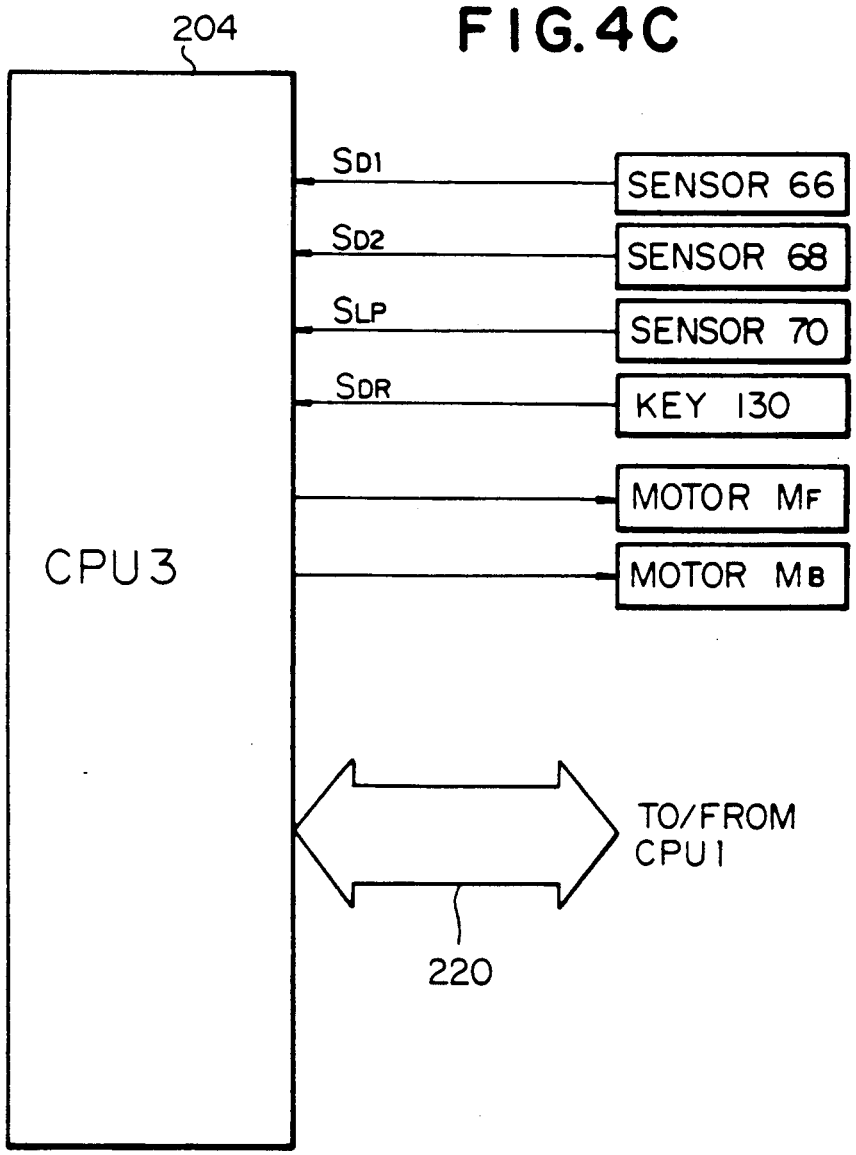

FIGS. 4A, 4B and 4C show the general arrangement of a control circuit which may be used to achieve the functions hereinbefore described with reference to FIGS. 1 to 3. The control circuit comprises first, second and third central processing units 200, 202 and 204 (respectively labeled CPU1, CPU2 and CPU3) which have interrupt (INT) and data input and output ($S_{IN}$, $S_{OUT}$) ports connected together through bus lines 206. The first central processing unit 200 is operative to control the operation of the image reproducing system 22, print sheet feed system 24, image fixing system 26 and print sheet recirculation system 28 of the image duplicator module 10 while the second central processing unit 202 is predominant over the operation of the optical scanning system 20 of the image duplicator module 10. The third central processing unit 204 is operative to control the operation of particularly the automatic document feed module 12.

As shown in FIG. 4A, the first central processing unit 200 has input terminals connected to a matrix circuit 208 composed of normally-open switch elements including those associated with the various keys provided on the control panel 100 and the segment electrodes of the display window 106 on the control panel 100. The central processing unit 100 further has output terminals including those connected through an address decoder 210 to the matrix circuit 208 and to switch elements 212 for the display window 106 and light emitting diodes (LEDs) implementing the various indicators (herein indicated collectively at 214) provided on the control panel 100.

As shown in FIG. 4B, the first central processing unit 200 further has terminals A1, A2, . . . An connected to switch and actuator elements of the driver circuits for the various electrically driven units of the image reproducing system 22, print sheet feed system 24, image fixing system 26 and print sheet recirculation system 28 of the image duplicator module 10. These units include a motor for driving the image transfer drum 30, a drive motor provided in the developing assembly, clutches for the print sheet feed and and recirculation rollers, and chargers and charge eraser lamps provided in association with the image transfer drum 30. The first central processing unit 200 is further connected to a random-access memory (RAM) 216 for storing data supplied from the switch elements included in the matrix circuit 208.

The second central processing unit 202 has input terminals connected to sensors 218 provided in association with the optical scanning system 20 and is operative to control various driver circuits included in the scanning system 20. Such driver circuits include those connected to a drive motor for a scanning device composed of an exposure lamp and a mirror and a stepper motor for a magnification/reduction lens unit which forms part of the scanning system 20.

As shown in FIG. 4C, the third central processing unit 204 predominant over the operation of the automatic document feed module 12 has interrupt and data input and output ports connected through bus lines 220 to the first and second central processing units 200 and 202 and input terminals including those responsive to the signals SD1 and SD2 from the document-on-tray and document-on-table sensors 66 and 68 (FIG. 1), the signal $S_{LP}$ from the lid position sensor 70 (FIG. 2), and the signal $S_{DR}$ from the document discharge request key 130 on the control panel 100 (FIG. 3). The third central processing unit 204 further has output terminals connected to switch and actuator elements of the driver circuits for the various electrically driven units in the automatic document feed module 12 such as the roller drive motor $M_F$ and the belt drive motor $M_B$.

Figure 5:
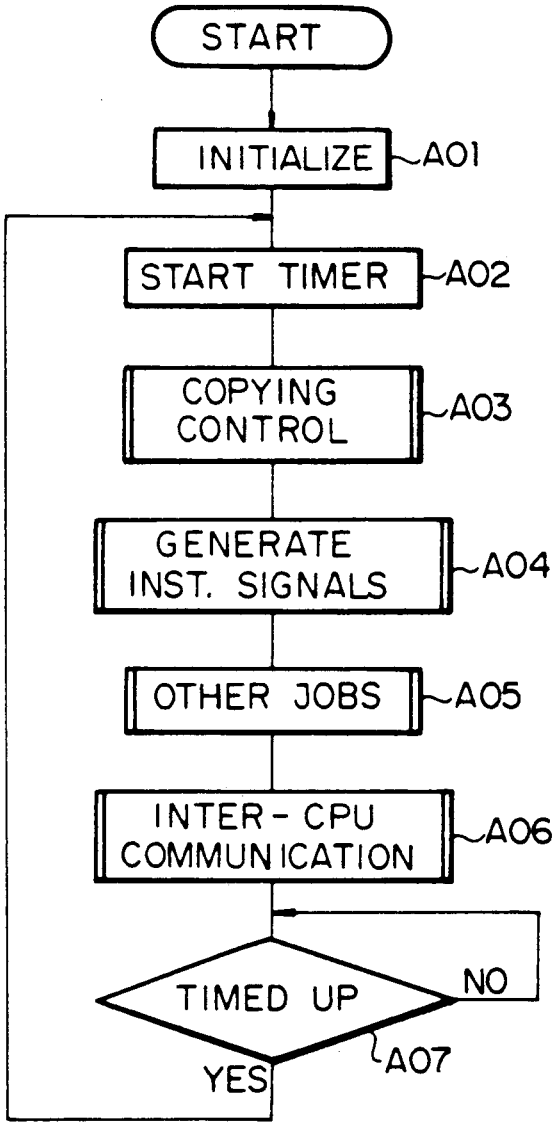
FIG. 5 a flowchart showing a preferred example of the main routine program to be executed by a master central processing unit included in the control circuit illustrated in FIGS. 4A to 4C.

FIG. 5 shows a preferred example of the main routine program to be executed by the first central processing unit 200. Referring to FIG. 5, such a main routine program program is executed with the apparatus initially switched in and starts with a step A01 to initialize the various registers included in the central processing unit 200 and the random-access memory 216 associated with the central processing unit 200. The data representative of the various conditions and modes of operation that may have been memorized in the memory 216 and registers of the central processing unit 200 are thus initialized in accordance with prescribed "default" rules. An internal timer of the central processing unit 200 is then started at step A02 to count a time interval predetermined for a single complete iteration through the routine program.

The central processing unit 200 may then execute a copying control subroutine program A03 through which copying operation is performed by the image duplicator module 10 in the modes and conditions selected from the control panel 100. At a point of time a specified number of printed outputs have been produced through execution of the copying control subroutine program A03, the first central processing unit 200 transmits to the third central processing unit 204 a signal indicating that the cycles of copying operation are complete.

The first central processing unit 200 may further execute an instruction signal generating subroutine program A04 to generate an instruction signal to enable the image duplicator module 10 or automatic document feed module 12 to start operation on the basis of the signal $S_{PS}$ from the print start key 102, the signal $S_{DP}$ from the document discharge prohibit key 128, the signal $S_{D1}$ from the document-on-tray sensor 66, and the signal $S_{LP}$ from the lid position sensor 70. The copying control subroutine program A03 is executed when a duplicator start instruction signal ($S_{DUP}$) is set to logic "1" to enable the image duplicator module 10 to start operation or when a similar signal is received from the third central processing unit 204. The details of this instruction signal generating subroutine program A04 will be hereinafter described with reference to FIG. 6.

The first central processing unit 200 may then proceed to subroutine programs A05 to perform various other jobs required for the copying of an original document sheet or original document sheets. The central processing unit 200 may further execute a subroutine program A06 to communicate with the second central processing unit 202 for the control of the optical scanning system 10 of the duplicator module 10 and with the third central processing unit 204 for the control of the automatic document feed module 12.

When it is thereafter determined at step A07 that the time counted by the internal timer of the central processing unit 200 as started at step A02 has lapsed, the central processing unit 200 reverts to the step A02 and recycles the subroutine programs A02 to A07.

Figure 6:
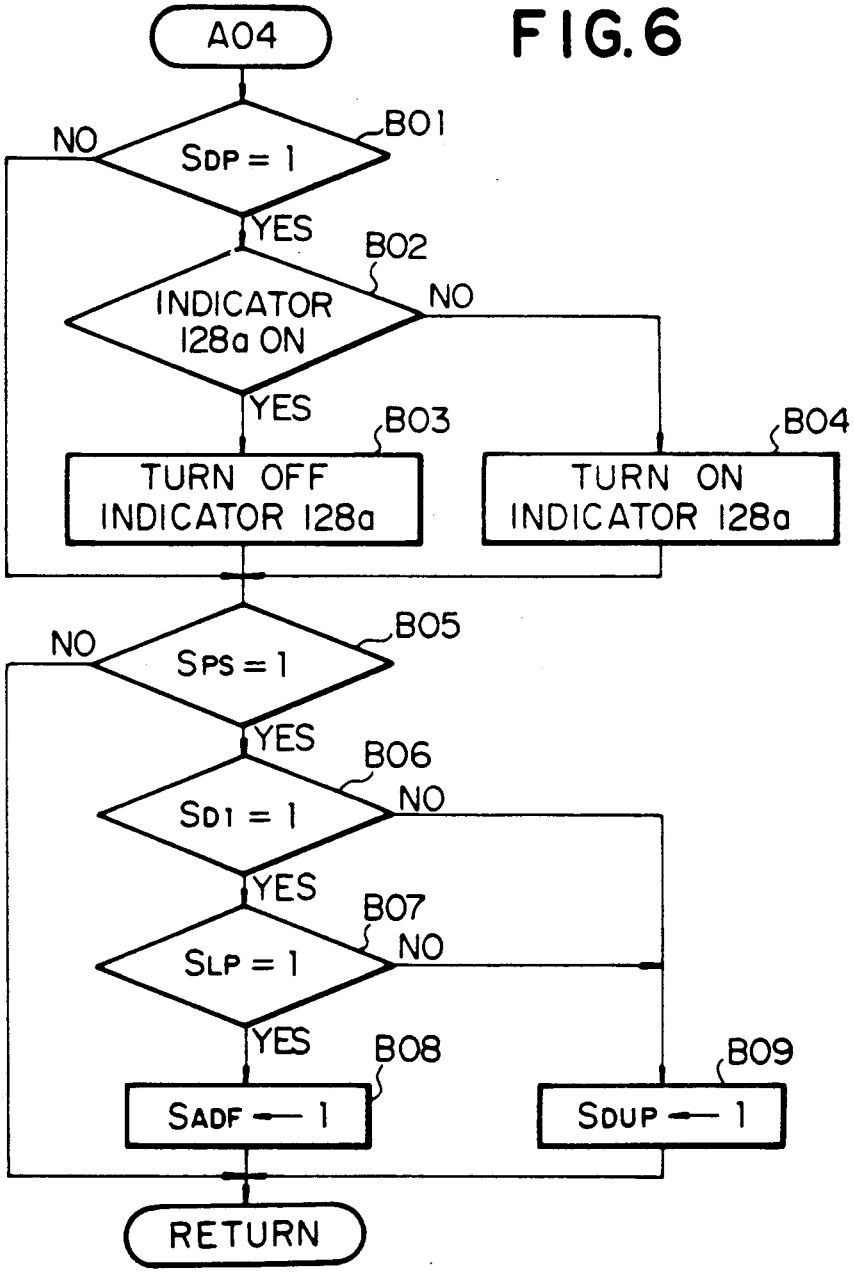
FIG. 6 is a flowchart showing the details of an instruction signal generating subroutine program included in the main routine program illustrated in FIG. 5.

FIG. 6 shows the instruction signal generating subroutine program A04 included in the main routine program hereinbefore described. The instruction signal generating check if there is the signal $S_{DP}$ of logic "1" state generated with the document discharge prohibit key 128 depressed. If it is found that there currently is such a signal, the step B01 is followed by step B02 to detect whether or not the indicator 128*a* associated with the document discharge prohibit key 128 is turned on. If the answer for this step B02 is given in the affirmative, the indicator 128*a* is de-activated to turn off at step B03 and, if on the contrary, the indicator 128*a* is activated to turn on at step B04.

Subsequent to step B03 or B04 or when it is found at step B01 that the signal $S_{DP}$ from the document discharge prohibit key 128 is of a logic "0" state, it is queried at step B05 whether or not there is the signal $S_{PS}$ of logic "1" state generated with the print start key 102 depressed. If it is found that there is such a signal present, the step B05 is followed by step B06 to detect whether or not the signal $S_{D1}$ from the document-on-tray sensor 66 is of a logic "1" state. If the answer for this step B06 is given in the affirmative, it is determined that there is an original document sheet placed on the document supply tray 48 so that the step B06 is followed by a step B07 to detect whether or not the signal $S_{LP}$ from the lid position sensor 70 is of a logic "1" state. If the answer for this step B07 is also given in the affirmative, it is determined that the lid structure 52 of the document discharge assembly 44 is closed on the document support table 16 of the image duplicator module 10 so that the step B07 is followed by a step B08 to set an ADF start instruction signal $S_{ADF}$ to a logic "1" state. The ADF start instruction $S_{ADF}$ is effective to enable the automatic document feed module 12 to start operation. If the answer for at least one of the steps B06 and B07 is given in the negative with no original document sheet placed on the document supply tray 48 and/or the lid structure 52 held open from the document support table 16, then the step B07 is followed by a step B09 to set a duplicator start instruction signal $S_{DUP}$ to a logic "1" state. The duplicator start instruction $S_{DUP}$ is effective to enable the image duplicator module 10 to start operation in accordance with the subroutine program A03 included in the main routine program described with reference to FIG. 5.

Subsequently to the step B08 or B09 or when the answer for the step B05 is given in the negative in the absence of the signal $S_{PS}$ of logic "1" state, the instruction signal generating subroutine program A04 returns to the main routine program shown in FIG. 5 and may be followed by the subroutine program A05.

Figure 7:
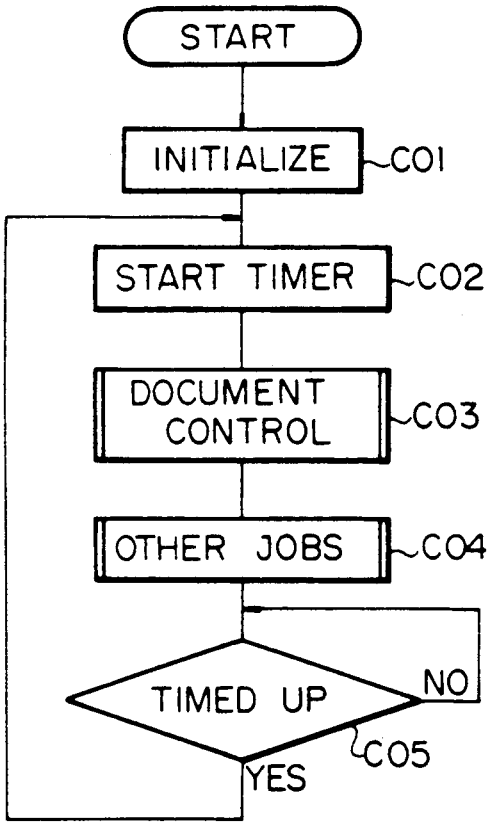
FIG. 7 a flowchart showing a preferred example of the main routine program to be executed by a slave central processing unit also included in the control circuit illustrated in FIGS. 4A to 4C.

FIG. 7 shows a preferred example of the main routine program to be executed by the third central processing unit 204 included in the control circuit described with reference to FIGS. 4A to 4C.

The routine program starts with a step C01 for initializing the third central processing unit 204. All the data representative of the document feeding conditions that may have been memorized in the internal registers and associated memory of the central processing unit 204 are thus initialized in accordance with prescribed default rules. An internal timer of the central processing unit 204 is then started at a step C02 to count the time interval predetermined for a single complete iteration through the routine program.

The third central processing unit 204 is predominant over the operation of the automatic document feed module 100 and further has a document control subroutine program C03. This document control subroutine program C03 is executed to control the operation of the automatic document feed module 00 to supply an original document sheet from the document supply assembly 40 to the correct exposure position on the document support table 16, transport the document sheet through the document transport assembly 42 after the document sheet has been scanned by the optical scanning system 20, and discharge the original document sheet out of the document transport assembly 42. The third central processing unit 204 may then proceed to subroutine programs A05 to perform various other jobs required for the automatic feeding of an original document sheet or original document sheets. When it is thereafter confirmed at step C05 that the time set at step C02 has lapsed, then the routine program recycles to the step C02. Details of the document control subroutine program C03 will be hereinafter described with reference to FIGS. 9A and 9B.

Figure 8:
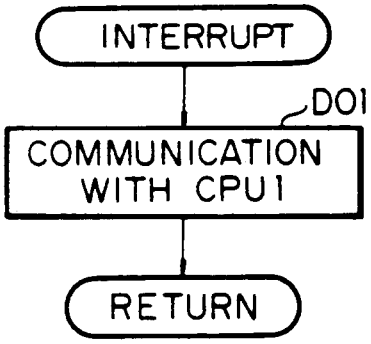
FIG. 8 is a flowchart showing an interrupt subroutine program to be executed by the slave central processing unit.

Communication of data from each of the first central processing unit 200 to the third central processing unit 204 is effected independently of the routine program herein shown on the basis of interrupt demand signal issued from the first central processing unit 200. FIG. 8 shows a subroutine program which the third central processing unit 204 is to execute when interrupted by the first central processing unit 200. Through this subroutine program, the third central processing unit 204 communicates with the first central processing unit 200 as at step D01 when interrupted.

Figure 9A:
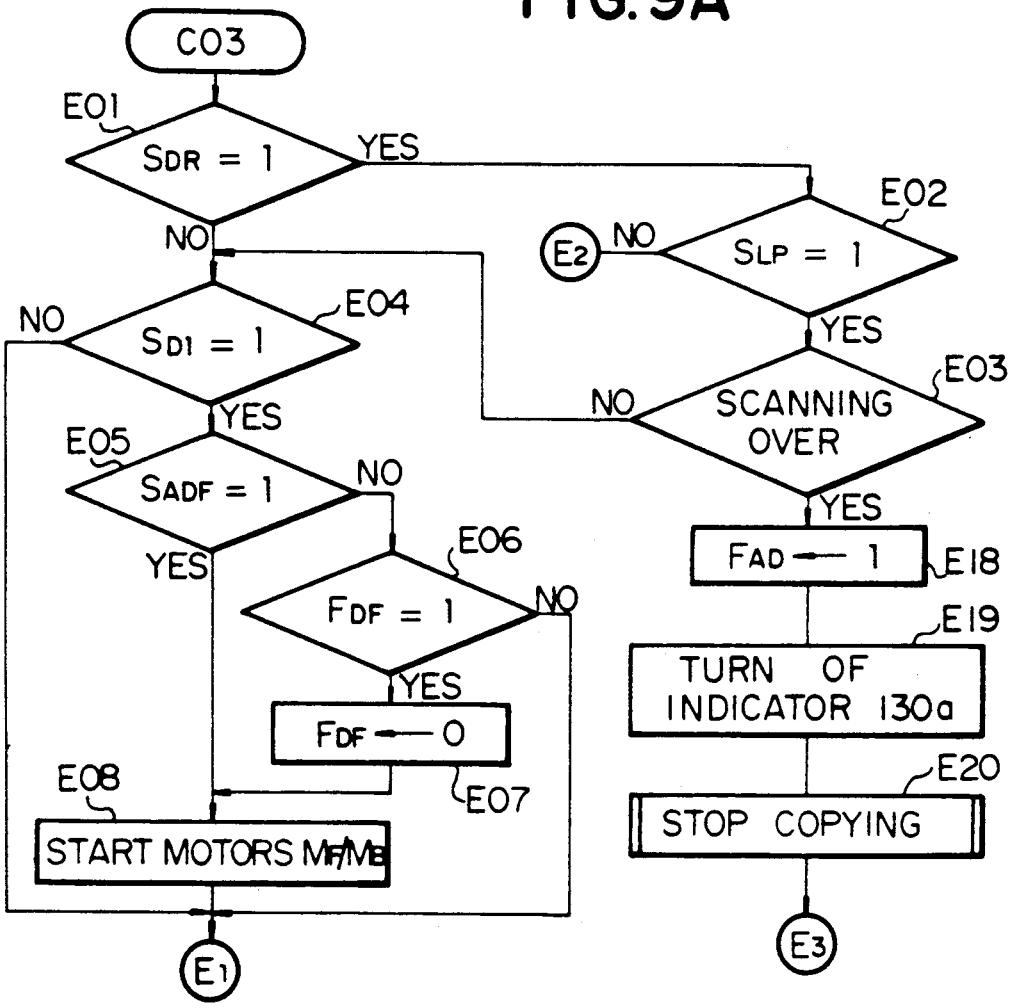
FIGS. 9A and 9B are flowcharts showing the details of a document control subroutine program included in the main routine program illustrated in FIG. 7.
Figure 9B:
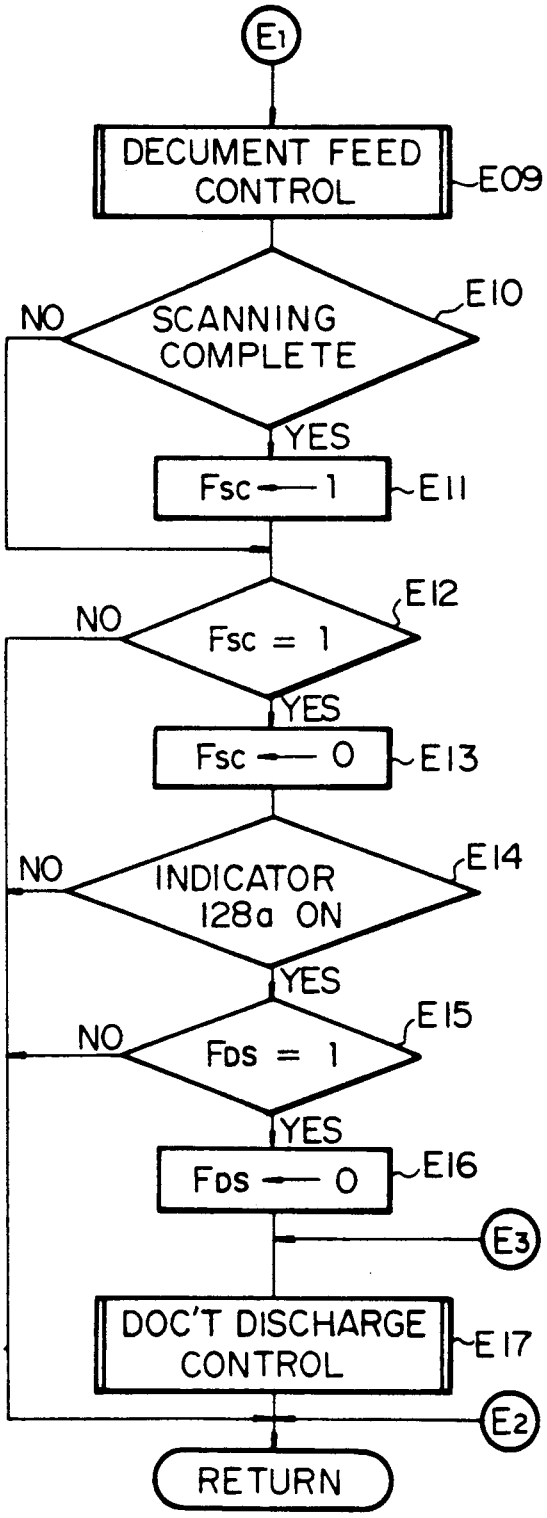

FIGS. 9A and 9B show the details of the document control subroutine program C03 included in the main routine program described with reference to FIG. 7.

Referring to FIG. 9A, the document control subroutine program C03 starts with a step E01 at which is questioned whether or not there is the signal $S_{DR}$ of logic "1" state produced with the document discharge request key 130 depressed. If the answer for this step E01 is given in the affirmative, the step E01 is followed by step E02 to check if there is the signal $S_{LP}$ of logic "1" produced from the lid position sensor 70. If the answer for this step E02 is given in the affirmative, it is determined that the lid structure 52 of the document transport assembly 42 is closed on the document support table 16 of the image duplicator module 10 and as such the step E02 is followed by step E03 to detect whether or not the scanning of the original document sheet in the current cycle of copying operation has been terminated.

If it is found at this step E03 that the scanning operation is still incomplete or it is determined at step E01 that there is the signal $S_{DR}$ of logic "0" state with the lid structure 52 held open, the third central processing unit 204 proceeds to step E04 to check if the signal $S_{D1}$ from the document-on-tray sensor 66 is of a logic "1" state with an original document sheet placed on the document supply tray 48. If it is found at this step E04 that there is the signal $S_{D1}$ of logic "1" state, the step E04 is followed by a step E05 which is responsive to the ADF start instruction signal $S_{ADF}$ which may be produced at step B08 of the subroutine program A04 and supplied from the first central processing unit 200. At the step E05 is thus queried whether or not there is present the ADF start instruction signal $S_{ADF}$ of logic "1" state. If it is found at the step E05 that there is no signal $S_{ADF}$ of logic "1" state, then the step E05 is followed by step E06 to test whether or not a document feed flag $F_{DF}$ of, for example, a logic "1" state is currently present. If the answer for this step E06 is given in the affirmative, then the document feed flag $F_{DF}$ is reset to logic "0" state at step E07.

Subsequently to the step E07 or if it is found at the step E05 that the ADF start instruction signal $S_{ADF}$ of logic "1" state is present, the third central processing unit 204 proceeds to step E08 at which instruction signal are issued from the central processing unit 204 so that the roller drive motor $M_F$ in the document supply assembly 40 and the belt drive motor $M_B$ in the document transport assembly 42 of the automatic document feed module 12 are actuated to start. The belt drive motor $M_B$ being thus initiated into operation, the transport belt 58 is to be driven to have its lower travelling path portion moved forwardly.

Subsequently to the step E08 or if the answer for the step E04 or the step E06 is given in the negative, the third central processing unit 204 proceeds through a connector $E_1$ to a document feed control subroutine program E09 illustrated in FIG. 9B. This document feed control subroutine program E09 is executed to convey the original document sheet in the document supply assembly 40 to a prescribed exposure position on the document support table 16 of the image duplicator module 10. The details of this document feed control subroutine program E09 will be hereinafter described with reference to FIG. 10.

After the document feed control subroutine program E09 has been executed, the third central processing unit 204 proceeds to a step E10 to question whether or not the scanning of the original document sheet on the document support table 16 has been repeated the required number of times. If the answer for this step E10 is given in the affirmative, then a scan complete flag $F_{SC}$ of, for example, a logic "1" state is raised at step E11. Subsequently to this step E11 or if it is found at the preceding step E10 that the scanning operation has not been repeated the preset number of times, then it is questioned at step E12 whether or not the scan complete flag $F_{SC}$ of logic "1" state is present. If the answer for this step E12 is given in the affirmative, the scan complete flag $F_{SC}$ is reset to logic "0" state at step E13.

It is then tested at step E14 whether or not the indicator **128*a* associated with the document discharge prohibit key 128 is turned off. If it is found at this step E14 that the indicator 128*a* is turned off, it is further queried at step E15 whether or not a document set flag $F_{DS}$ of a logic "1" state has been set. If the answer for this step E15 is given in the affirmative, the document set flag $F_{DS}$ is reset to a logic "0" state as at step E16 and, thereafter, the third central processing unit 204 proceeds to a document discharge subroutine program E17. The details of this document discharge subroutine program E17 will be hereinafter described with reference to FIG. 11. After the document discharge subroutine program E17 has been executed, the third central processing unit 204 reverts to the main routine program illustrated in FIG. 7 and may proceed to the subroutine program C04 thereof. When the answer for at least one of the steps E12, E14 and E15 is given in the negative, the central processing unit 204 reverts to the main routine program without executing the document discharge subroutine program E17**.

When it is determined at step E02 that there is no signal $S_{LP}$ of logic "1" produced from the lid position sensor 70, the central processing unit 204 determines that the lid structure 52 of the document transport assembly 42 is open from the document support table 16 of the image duplicator module 10 and reverts to the main routine program illustrated in FIG. 7. If it is found at step E03 that the scanning of the original document sheet in the current cycle of copying operation has been terminated, then the central processing unit 204 proceeds to step E18 to set an automatic document discharge flag $F_{AD}$ to a logic "1" state and further to step E19 to turn on the indicator 130*a* associated with the document discharge request key 130. The central processing unit 204 then executes a duplication stop subroutine program E20 to request the first central processing unit 200 to terminate the operation of the image duplicator module 10 and thereafter proceeds through a connector $E_3$ to the document discharge subroutine program E17. The steps of the duplication stop subroutine program E20 are similar to those to be executed when the clear/stop key 108 is depressed and as such are well known in the art. When it is found at step E03 that the scanning operation is in progress, the third central processing unit 204 proceeds to the step E04 without executing the document discharge subroutine program E17.

Figure 10A:
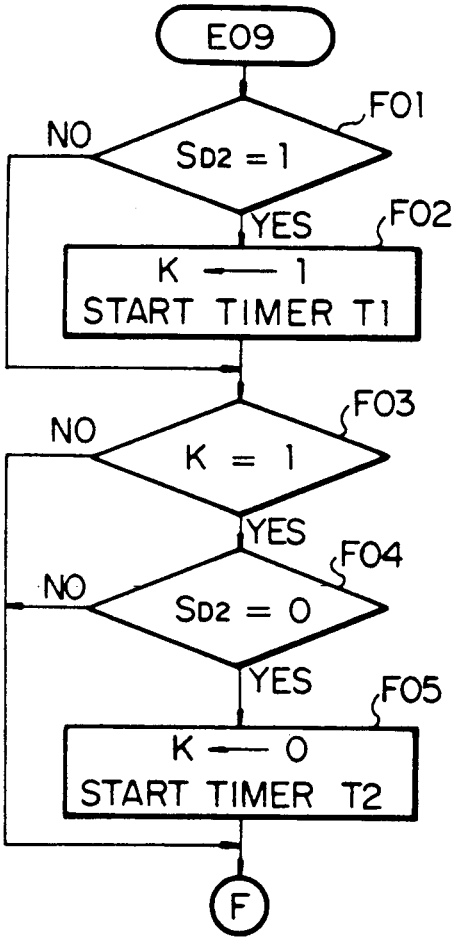
FIGS. 10A and 10B are flowcharts showing the details of a document feed control subroutine program included in the routine program illustrated in FIGS. 9A and 9B.
Figure 10B:
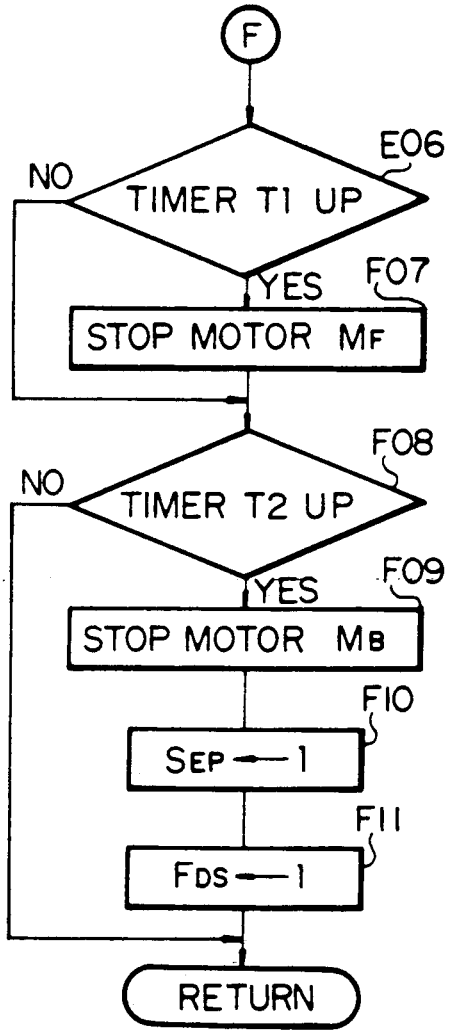

FIGS. 10A and 10B show the document feed control subroutine program E06 included in the document control subroutine program C03 described with reference to FIGS. 9A and 9B.

Referring to FIG. 10A, the document feed control subroutine E09 is executed to transport an original document sheet to a correct exposure position on the document support table 16 of duplicator module 10 by means of the transport belt 58 of the document transport assembly 42. Such a subroutine program E09 starts with a step F01 at which is queried whether or not there is present the signal $S_{D2}$ of logic "1" state produced by the document-on-table sensor 68. If it is found at the step F01 that such a signal is present, a flag "K" of, for example, a logic "1" state for memorizing the condition of the document-on-table sensor 68 is set at step F02 and at the same time a first system timer "T1" of the third central processing unit 204 is enabled to start counting operation at step F02. For this first system timer "T1" is set a period of time for which the roller drive motor $M_F$ in the document supply assembly 40 is to remain operative. The roller drive motor $M_F$ being actuated into operation at step E08 of the subroutine program C03, the original document sheet which has been placed into the document supply assembly 40 is driven to travel forwardly into the document transport assembly 42 until the sheet is brought into contact with the travelling transport belt 58.

Subsequently to the step F02 or if it is found at the preceding step F01 that there is no signal $S_{D2}$ of logic "1" state output from the document-on-table sensor 68, it is questioned at step F03 whether or not the flag "K" of logic "1" state is present. If the answer for this step F03 is given in the affirmative, it is further queried at step F04 whether or not there is a signal $S_{D2}$ of logic "0" state output from the document-on-table sensor 68. If it is found at this step F04 that such a signal is present, the flag "K" is reset to a logic "0" state and at the same time a second system timer "T2" of the central processing unit 204 is enabled to start counting operation at step F05. For this second system timer "T2" is set a time when the original document sheet travelling forwardly on the document support table 16 reaches a position having its trailing end at the rearmost end of the correct exposure position on the document support table 16. Subsequently to the step F05 or if it is found at the preceding step F03 that there is no flag "K" present or at the step F04 that there is no signal $S_{D2}$ of logic "0" state output from the document-on-table sensor 68, the third central processing unit 204 proceeds to step F06 to check whether or not the time preset for the first system timer "T1" has lapsed. If the answer for this step F06 is given in the affirmative, then the third central processing unit 204 issues an instruction to de-energize the roller drive motor $M_F$ in the document supply assembly 40 at step F07. Subsequently to this step F07 or if it is found at the preceding step F06 that the counting operation by the first system timer "T1" is still in progress, it is tested at step F08 whether or not the time preset for the second system timer "T2" has lapsed. If the answer for this step F08 is given in the affirmative, then the belt drive motor $M_B$ actuated into operation at step E08 of the subroutine program C03 is brought to a stop at step F09 and thereafter an exposure position signal $S_{EP}$ is set to logic "0" state at step F10 and the document set flag $F_{DS}$ is set to logic "1" state at step F11. Subsequently to the step F11 or if it is found at the preceding step F08 that the second system timer "T2" is still in operation, the third central processing unit 204 reverts to the subroutine program C03 illustrated in FIGS. 9A and 9B and may proceed to the step E09 thereof.

Figure 11:
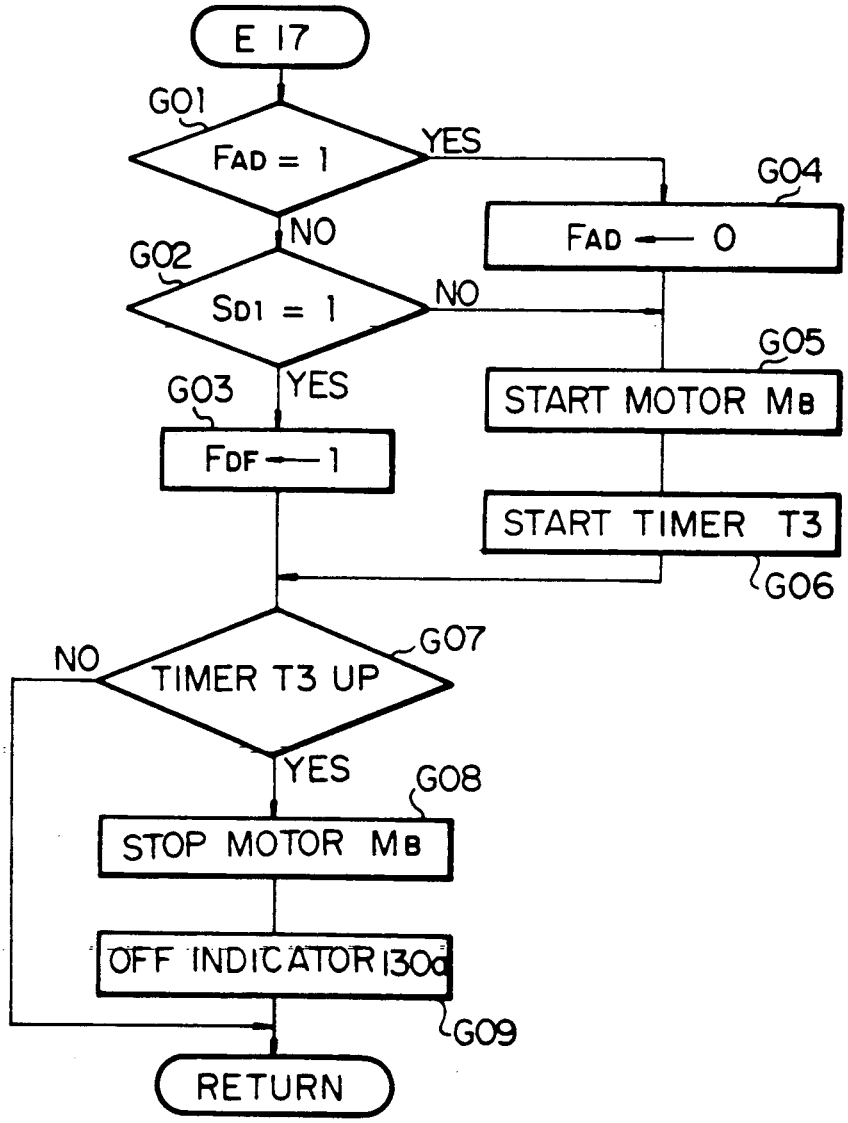
FIG. 11 is a flowchart showing the details of a document discharge control subroutine program included in the routine program illustrated in FIGS. 9A and 9B.

FIG. 11 shows the document discharge control subroutine program E17 included in the document control subroutine program C03 described with reference to FIGS. 9A and 9B.

In the document discharge control subroutine E17 is first determined whether or not there is an original document sheet inserted into the document supply assembly 40. In the presence of an original document sheet on the document supply tray 48, the central processing unit 204 memorizes the particular event and, if there is no original document sheet found on the document supply tray 48, then the central processing unit 204 actuates the automatic document feed module 12 to discharge the original document sheet on the document support table 16 out of the apparatus.

Referring to FIG. 11, such a document discharge control subroutine program E17 starts with a step G01 to check if the automatic document discharge flag $F_{AD}$ is set to logic "1" state. If the answer for this step G01 is given in the negative, it is confirmed at step G02 whether or not there is an original document sheet placed in the document supply assembly 40. This confirmation is made on the basis of the signal $S_{D1}$ supplied from the document-on-tray sensor 66 located within the document supply assembly 40. If it is found at this step G02 that there is an original document sheet in the document supply assembly 40, the document feed flag $F_{DF}$ of logic "1" state is set at step G03.

If it is determined at step G01 that the automatic document discharge flag $F_{AD}$ is set to logic "1" state, the flag $F_{AD}$ is reset to logic "0" state at step G04. Subsequently to this step G04 or when it is determined at step G02 that the signal $S_{D1}$ from the document-on-tray sensor 66 is of a logic "0" state, then the belt drive motor $M_B$ in the document transport assembly 42 is actuated for rotation in the forward direction as at step G05 so that the original document sheet on the document support table 16 is driven by the transport belt 58 for forward movement on the table 16. A third system timer "T3" of the central processing unit 204 is then enabled to start counting operation at step G06. For this third system timer "T3" is set the time for which an original document sheet of possibly the largest standardized size that may be placed on the support table 16 will be allowed to move on and leave the document support table 16.

Either the step G03 or the step G06 is followed by a step G07 at which is tested whether or not the third system timer "T3" has terminated its counting operation. If it is found at the step G07 that this is the case, the belt drive motor $M_B$ is de-energized and is thus brought to a stop at step G08. Thereafter, the central processing unit 204 proceeds to step G09 to turn off the indicator 130a associated with the document discharge request key 130. Subsequently to the step G09 or if it is found at the preceding step G07 that the third system timer "T3" of the central processing unit 204 is still in operation, the central processing unit 204 reverts to the subroutine program C03 described with reference to FIGS. 9A and 9B and may proceed to the routine program C04 of the main routine program of FIG. 7.

It has been hereinbefore described that, when the automatic document discharge request key 130 is depressed, an original document sheet is automatically withdrawn from the document support table 16 of the image duplicator module 0 immediately after the scanning operation currently in progress is terminated. If desired, such arrangement may be modified so that, when an original document sheet has been manually placed on the document support table 16 with the lid structure 52 opened up from the document support table 16, the original document sheet is automatically withdrawn from the document support table 16 upon termination of the scanning operation in the final cycle of copying operation.

What is claimed is:

1. An image duplicating apparatus, comprising:

(a) a transparent document support table, (b) an image forming device for copying images on an original document sheet placed on said document support table, (c) an original document feeding device for conveying an original document sheet to a predetermined position on said document support table and discharging the original document sheet from said predetermined position, said original document feeding device being angularly movable from a closed position confronting said document support table to an angular position allowing manual access to said document support table, (d) manual input means allowing manual entry of an automatic document discharge instruction for automatically discharging a manually placed original document sheet from said document support table, (e) a control device responsive to said automatic document discharge instruction for activating said original document feeding device to automatically discharge the manually placed original document sheet from said document support table when said original document feeding device is in said closed position.

2. An image duplicating apparatus, comprising:

(a) a transparent document support table, (b) an image forming device for copying images on an original document sheet placed on said document support table, (c) an original document feeding device for conveying an original document sheet to a predetermined position on said document support table and discharging the original document sheet from said predetermined position, said original document feeding device being angularly movable from a closed position confronting said document support table to an angular position allowing manual access to said document support table, (d) first input means for entering an instruction to start a copying operation, (e) first control means responsive to said instruction for controlling said image forming device and said original document feeding device so that said image forming device and said original document feeding device operate in conjunction with each other for automatically conveying an original document sheet to said predetermined position on said document support table and discharging the original document sheet from said predetermined position after the copying operation for the particular original document sheet is terminated, said first control means being operative to enable said image forming device to start a copying operation without the intervention of said original document feeding device when said first control means responds to said instruction after an original document sheet has been manually placed on said document support table with said original document feeding device held in said angular position, said first control means being further operative to produce an automatic document discharge prohibit instruction to prohibit automatic discharge of the manually placed original document sheet from said document support table after the copying operation for the particular original document sheet is terminated, (f) second input means allowing manual entry of an automatic document discharge instruction for automatically discharging the manually placed original document sheet from said document support table, and (g) second control means responsive to said automatic document discharge instruction for invalidating said automatic document discharge prohibit instruction when said original document feeding device is in said closed position.

3. An image duplicating apparatus, comprising:

(a) a transparent document support table, (b) an image forming device for copying images on an original document sheet placed on said document support table, (c) an original document feeding device for conveying an original document sheet to a predetermined position on said document support table and discharging the original document sheet from said predetermined position, said original document feeding device being angularly movable from a closed position confronting said document support table to an open angular position allowing manual access to said document support table, (d) first input means for entering an instruction to start a copying operation, (e) first control means responsive to said instruction for controlling said image forming device and said original document feeding device so that said image forming device and said original document feeding device operate in conjunction with each other for automatically conveying an original document sheet to said predetermined position on said document support table and discharging the original document sheet from said predetermined position after the copying operation for the particular original document sheet is terminated, said first control means being operative to enable said image forming device to start a copying operation without the intervention of said original document feeding device when said first control means responds to said instruction after an original document sheet has been manually placed on said document support table with said original document feeding device held in said open angular position, said first control means being further operative to produce an automatic document discharge prohibit instruction to prohibit automatic discharge of the manually placed original document sheet from said document support table after the copying operation for the particular original document sheet is terminated, (f) second input means allowing manual entry of an automatic document discharge instruction for automatically discharging the manually placed original document sheet from said document support table, and (g) second control means responsive to said automatic document discharge instruction for activating said original document feeding device to automatically discharge the manually placed original document sheet from said document support table when said original document feeding device is in said closed position.

4. An image duplicating apparatus, comprising:

(a) an image forming device including a transparent document support table and operative to copy images on an original document sheet placed on said document support table, (b) an original document feeding device which is angularly movable from a closed position confronting said document support table to an open position allowing manual access to said document support table, said original document feeding device being operative to convey an original document sheet to a predetermined position on said document support table and discharge the original document sheet from said predetermined position when said original document feeding device is in said closed position, (c) a first input device allowing manual entry of a copying start instruction to start a copying operation, (d) a second input device allowing manual entry of an automatic document discharge instruction for automatically discharging a manually placed original document sheet from said document support table, and (e) a control device responsive to said copying start instruction for controlling said image forming device and said original document feeding device so that the image forming device and the original document feeding device operate in conjunction with each other for automatically conveying an original document sheet to said predetermined position on said document support table and discharging the original document sheet from said predetermined position when said original document feeding device is in said closed position after the copying operation for the particular original document sheet is terminated, said control device also being operative to control said original document feeding device and said image forming device to enable said image forming device to start a copying operation without activating said original document feeding device when said control device responds to said copying start instruction after an original sheet has been manually placed on said document support table with said original document feeding device held in said open position, said control device being responsive to said automatic document discharge instruction for activating said original document feeding advice to discharge the manually placed original document sheet from said document support table when said original document feeding device is in said closed position.

* * * * *